US010093509B2

(12) United States Patent
Kawano et al.

(10) Patent No.: US 10,093,509 B2
(45) Date of Patent: Oct. 9, 2018

(54) IMAGE PROCESSING APPARATUS

(71) Applicant: SHARP KABUSHIKA KAISHA, Osaka-shi, Osaka (JP)

(72) Inventors: Masahiro Kawano, Osaka-shi (JP); Takashi Matsuda, Osaka-shi (JP); Naoki Saito, Osaka-shi (JP); Kenji Ohta, Osaka-shi (JP)

(73) Assignee: SHARP KABUSHIKI KAISHA, Sakai, Osaka (JP)

( * ) Notice: Subject to any disclaimer, the term of this patent is extended or adjusted under 35 U.S.C. 154(b) by 386 days.

(21) Appl. No.: 14/340,183

(22) Filed: Jul. 24, 2014

(65) Prior Publication Data

US 2014/0333020 A1 Nov. 13, 2014

Related U.S. Application Data

(62) Division of application No. 13/214,620, filed on Aug. 22, 2011, now Pat. No. 8,820,731.

(30) Foreign Application Priority Data

Aug. 23, 2010 (JP) ..... 2010-186507

(51) Int. Cl.
*B65H 31/04* (2006.01)
*G03G 15/00* (2006.01)

(52) U.S. Cl.
CPC ..... *B65H 31/04* (2013.01); *G03G 15/5016* (2013.01); *G03G 2215/00004* (2013.01)

(58) Field of Classification Search
CPC ..... B65H 2515/60; G03G 15/5016
USPC ..... 271/3.14, 207; 399/81, 107, 363, 405; D18/37–39, 41
See application file for complete search history.

(56) References Cited

U.S. PATENT DOCUMENTS

| | | | | |
|---|---|---|---|---|
| 4,896,223 | A | 1/1990 | Todome | |
| 5,839,025 | A | 11/1998 | Okauchi et al. | |
| 5,953,135 | A | 9/1999 | Tomoe et al. | |
| 7,062,197 | B2 * | 6/2006 | Kunugi ..... | G03G 15/5016 399/107 |

(Continued)

FOREIGN PATENT DOCUMENTS

| | | | |
|---|---|---|---|
| JP | 63-231366 | A | 9/1988 |
| JP | 9-325548 | A | 12/1997 |

(Continued)

*Primary Examiner* — Jeremy R Severson
(74) *Attorney, Agent, or Firm* — Birch, Stewat, Kolasch & Birch, LLP

(57) ABSTRACT

An image processing apparatus according to the present invention has: an apparatus main body whose external appearance is configured from an upper casing, a lower casing, and a link casing that vertically links the upper casing and the lower casing and that has a paper discharge opening for discharging paper on one side face; a paper discharge portion that is formed as a space between the upper casing and the lower casing and that is to store paper discharged from the paper discharge opening; and an operation panel portion that is disposed in a vertically tiltable manner on a front face of the upper casing. When viewing the apparatus main body from the front side, an open space that allows paper discharged to the paper discharge portion to be viewed is provided between the operation panel portion and the link casing.

13 Claims, 7 Drawing Sheets

(56) References Cited

U.S. PATENT DOCUMENTS

| | | | | |
|---|---|---|---|---|
| 7,386,245 | B2 * | 6/2008 | Mitsuhashi | H04N 1/00496 399/81 |
| D664,191 | S | 7/2012 | Saito et al. | |
| D664,591 | S | 7/2012 | Ohta et al. | |
| D665,012 | S | 8/2012 | Saito et al. | |
| 2008/0175640 | A1 | 7/2008 | Akiyama | |
| 2009/0142095 | A1 | 6/2009 | Nishizawa | |
| 2010/0067941 | A1 | 3/2010 | Inui et al. | |
| 2011/0200374 | A1 | 8/2011 | Saito et al. | |
| 2011/0262172 | A1 * | 10/2011 | Nakamura | G03G 15/5016 399/81 |
| 2014/0239064 | A1 * | 8/2014 | Onishi | G03G 15/5066 235/380 |

FOREIGN PATENT DOCUMENTS

| | | | |
|---|---|---|---|
| JP | 11-199120 | A | 7/1999 |
| JP | 2002-128364 | A | 5/2002 |
| JP | 2002-344674 | A | 11/2002 |
| JP | 2006-067430 | A | 3/2006 |
| JP | 2007-334157 | A | 12/2007 |
| JP | 2008-083725 | A | 4/2008 |
| JP | 2008-176187 | A | 7/2008 |
| JP | 2009-139434 | A | 6/2009 |

* cited by examiner

IMAGE PROCESSING APPARATUS

CROSS-REFERENCE TO RELATED APPLICATION

This application is a Divisional of copending application Ser. No. 13/214,620, filed on Aug. 22, 2011, which claims priority under 35 U.S.C. § 119(a) to Application No. 2010-186507, filed in Japan on Aug. 23, 2010, all of which are hereby expressly incorporated by reference into the present application.

BACKGROUND OF THE INVENTION

Field of the Invention

The present invention relates to an image processing apparatus having an in-body paper discharge structure in which the external appearance of the apparatus main body is configured from an upper casing, a lower casing, and a link casing that links the upper casing and the lower casing, and, more specifically, relates to an image processing apparatus in which an operation panel portion is disposed in a vertically tiltable manner on a front face of the upper casing.

Description of the Related Art

Conventionally, various image processing apparatuses having an in-body paper discharge structure (so-called inner paper discharge structure) have been proposed in which an operation panel portion is disposed in a vertically tiltable manner on a front face of the upper casing (see JP 2007-334157A and JP 2009-139434A, for example).

JP 2007-334157A (hereinafter, referred to as PTL 1) discloses an image forming apparatus (image processing apparatus) in which an operation panel disposed on a front face of the apparatus main body is attached in a tiltable manner about a tilting axis that extends in the right-and-left horizontal direction, and the posture of the operation panel inclined about the tilting axis can be adjusted so as to be changed in a plurality of stages by a posture adjusting mechanism disposed between the apparatus main body and the operation panel.

Furthermore, JP 2009-139434A (hereinafter, referred to as PTL 2) discloses an image forming apparatus (image processing apparatus) in which installed is an operation portion angle adjusting device provided with an operation portion that is pivotally supported by the apparatus main body in a vertically tiltable manner and an adjustment mechanism that changes the vertical angle of the operation portion.

The image processing apparatuses stated in PTLS 1 and 2 above are of a tilt-type in which the operation panel or the operation portion (hereinafter, referred to as an "operation panel portion") is vertically tiltable, and have a universal design in consideration of use by a wheelchair user. That is to say, in conventional examples where the operation panel portion is horizontally fixed, a wheelchair user finds it difficult to view the panel screen, and, thus, the above-described image processing apparatuses have adopted a configuration in which the operation panel portion can be tilted downward (e.g., caused to be inclined at an angle of 45 degrees), so that the user can perform various operations at a position substantially facing the operation panel portion.

Meanwhile, the number of functions of an image processing apparatus is recently increasing, and the number of keys also tends to be increasing in order to correspond to the respective functions. Thus, in order to improve the visibility and the operability, a recent operation panel portion has a large-screen touch panel-type liquid crystal display portion that is disposed at the center thereof, and analog keys (mechanical keys) such as a numeric keypad and an on/off key that are arranged next to the display portion, and the size of the operation panel portion tends to increase. Thus, the operation panel portion has a shape that is gradually projected frontward toward the operator.

Also in the image processing apparatuses stated in PTLS 1 and 2, an operation panel portion having a size that covers substantially the entire length of the front face of the apparatus main body is provided, and this large-size operation panel portion can be vertically tilted.

In image processing apparatuses having an inner paper discharge structure, a paper discharge portion is positioned between the upper casing and the lower casing, and, thus, when the user performs a copy operation of the like standing in front of the image processing apparatus, it is very difficult for the user to view paper discharged to the paper discharge portion. Thus, some apparatuses have schemes for making it easy to view the inside of the paper discharge portion by increasing the vertical distance in the space of this paper discharge portion or schemes for making it easy to view discharged white paper by setting the color of the inner wall of the paper discharge portion to colors such as black or blue. Such schemes are effective in the case where the space on the front side of the paper discharge portion (the front face side of the apparatus main body) is sufficiently open. However, in the case of image processing apparatuses provided with a tilt-type operation panel portion, if the operation panel portion is tilted downward, the operation panel portion blocks the open portion on the front side of the paper discharge portion, and, thus, it is not sufficiently easy to check or pick up discharged paper with the above-described schemes alone.

SUMMARY OF THE INVENTION

The present invention was made in view of the above-described circumstances, and it is an object thereof to provide an image processing apparatus having an inner paper discharge structure with a tilt-type operation panel portion, in which, even in a state where the operation panel portion is inclined, it is possible to easily check paper discharge status or pick up paper.

The present invention is directed to an image processing apparatus, including: an apparatus main body whose external appearance is configured from an upper casing that contains an image capture portion, a lower casing that contains an image forming portion and a paper feed portion, and a link casing that vertically links the upper casing and the lower casing and that has a paper discharge opening for discharging paper on one side face; a paper discharge portion that is formed as a space open on a front side of the apparatus main body between the upper casing and the lower casing, and that is to store paper discharged from the paper discharge opening; and an operation panel portion that is disposed in a vertically tiltable manner on a front face on the front side of the upper casing; wherein, when viewing the apparatus main body from the front side, a front face on the front side of the link casing is positioned on one side in an intersecting direction that intersects the linkage direction of the upper casing and the lower casing, the operation panel portion is positioned on another side in the intersecting direction, and an open space that allows paper discharged to the paper discharge portion to be viewed is provided between the operation panel portion and the link casing.

That is to say, according to the image processing apparatus of the present invention, an apparatus main body has an external appearance configured from an upper casing that contains an image capture portion, a lower casing that contains an image forming portion and a paper feed portion, and a link casing that vertically links the upper casing and the lower casing on one side and that has a paper discharge opening for discharging paper on one side face (on the inner side face positioned inside the apparatus main body), a paper discharge portion that is to store paper discharged from the paper discharge opening and that is formed as a space open on a front side in order to pick up the paper is disposed between the upper casing and the lower casing, and an operation panel portion is disposed in a vertically tiltable manner on a front face of the upper casing. In the thus configured image processing apparatus, the operation panel portion is disposed close to the other side on the upper casing opposite the side to which the link casing is attached, and an open space that allows paper discharged to the paper discharge portion to be viewed is provided between the operation panel portion and the link casing.

In such an image processing apparatus of the present invention, an open space that allows paper discharged to the paper discharge portion to be viewed is secured between the operation panel portion and the link casing, and, thus, even in a state where the tilt-type operation panel portion has been tilted downward, an operator facing the front face of the apparatus main body can easily view the status of paper being discharged to the paper discharge portion through this open space. Accordingly, paper can be easily picked up, and a failure to pick up paper can be prevented from occurring.

Furthermore, in the image processing apparatus of the present invention, a paper placement face of the paper discharge portion may have an inclined portion that is lowered toward the paper discharge opening, and the open space may be provided such that a paper alignment reference position at a lower edge portion of the inclined paper placement face can be viewed.

With this configuration, an operator facing the front face of the apparatus main body can view the paper alignment reference position through the open space, and, thus, can easily check paper discharged to the paper discharge portion. In this case, discharged paper is always aligned at the paper alignment reference position, and, thus, discharged paper can be reliably viewed regardless of the paper size.

Furthermore, in the image processing apparatus of the present invention, a width of the open space may be set to a width that allows an operator facing a front face on the front side of the apparatus main body to insert his or her hand into the paper discharge portion and pick up paper.

With this configuration, paper discharged to the paper discharge portion can be viewed, and, moreover, the paper can be picked up through the open space. Thus, for example, even in a state where the operation panel portion has been tilted downward and blocks the paper discharge portion, at least the open space is always open, and, thus, the operator can easily pick up paper from the paper discharge portion.

Furthermore, in the image processing apparatus of the present invention, a side face on the one side in the intersecting direction of the operation panel portion may be formed as a first inclined face that is inclined from a front edge portion to a rear edge portion that is on the front face side of the upper casing. In other words, a side face on the one side in the intersecting direction of the operation panel portion may be formed so as to be inclined toward the open space. More specifically, the image processing apparatus may be configured such that an operator facing the front face on the front side of the apparatus main body can view the paper discharge portion along the first inclined face of the operation panel portion.

With this configuration, the first inclined face functions as a guide plate that guides the line of sight, and, thus, the line of sight of the operator can be naturally directed toward the open space. Accordingly, the operator naturally views the status of paper being discharged to the paper discharge portion, and, thus, a failure to pick up paper and the like can be prevented from occurring. Furthermore, this first inclined face functions as a guide plate also when the operator inserts his or her hand for picking up paper, and, thus, the operation panel portion does not interfere with the hand being inserted into the paper discharge portion.

Furthermore, in the image processing apparatus of the present invention, the front face of the link casing may be formed as a second inclined face that is inclined from an edge portion on the outer side to an edge portion on the open space side. In other words, the front face of the link casing may be formed so as to be inclined toward the inside of the paper discharge portion.

With this configuration, the second inclined face functions as a guide plate that guides the line of sight, and, thus, the line of sight of the operator can be naturally directed toward the open space. Accordingly, the operator naturally views the status of paper being discharged to the paper discharge portion, and, thus, a failure to pick up paper and the like can be prevented from occurring.

Furthermore, in the image processing apparatus of the present invention, a third inclined face that is inclined toward the paper discharge portion may be formed in a lower portion of the front face of the upper casing defining the open space.

With this configuration, the third inclined face functions as a guide plate that guides the line of sight, and, thus, the line of sight of the operator can be naturally directed toward the open space. Accordingly, the operator naturally views the status of paper being discharged to the paper discharge portion, and, thus, a failure to pick up paper and the like can be prevented from occurring.

That is to say, in the image processing apparatus of the present invention, in the case where three sides defining the open space are configured from the first inclined face, the second inclined face, and the third inclined face, from the view point of the operator facing the front face of the apparatus main body, all the inclined faces appear to be inclined toward the open space. Thus, the line of sight of the operator is naturally guided to the open space. Accordingly, the visibility of paper discharged to the paper discharge portion and the operability in subsequent processes (easiness in picking up paper) are improved.

Furthermore, in the image processing apparatus of the present invention, the operation panel portion may be a keyless panel configured from a display portion on which a touch panel has been installed. That is to say, the operation panel portion may be a keyless panel, which is not provided with analog keys such as a numeric keypad or an on/off key that have been arranged next to the touch panel-type display portion in conventional examples. With this configuration, the size of the operation panel portion can be reduced (in particular, the width can be reduced) by the size of analog keys that are not provided, and, as a result, an open space having a sufficient width can be secured between the operation panel portion and the link casing.

DETAILED DESCRIPTION OF THE INVENTION

Hereinafter, an embodiment of the present invention will be described with reference to the drawings.

Figure 1:
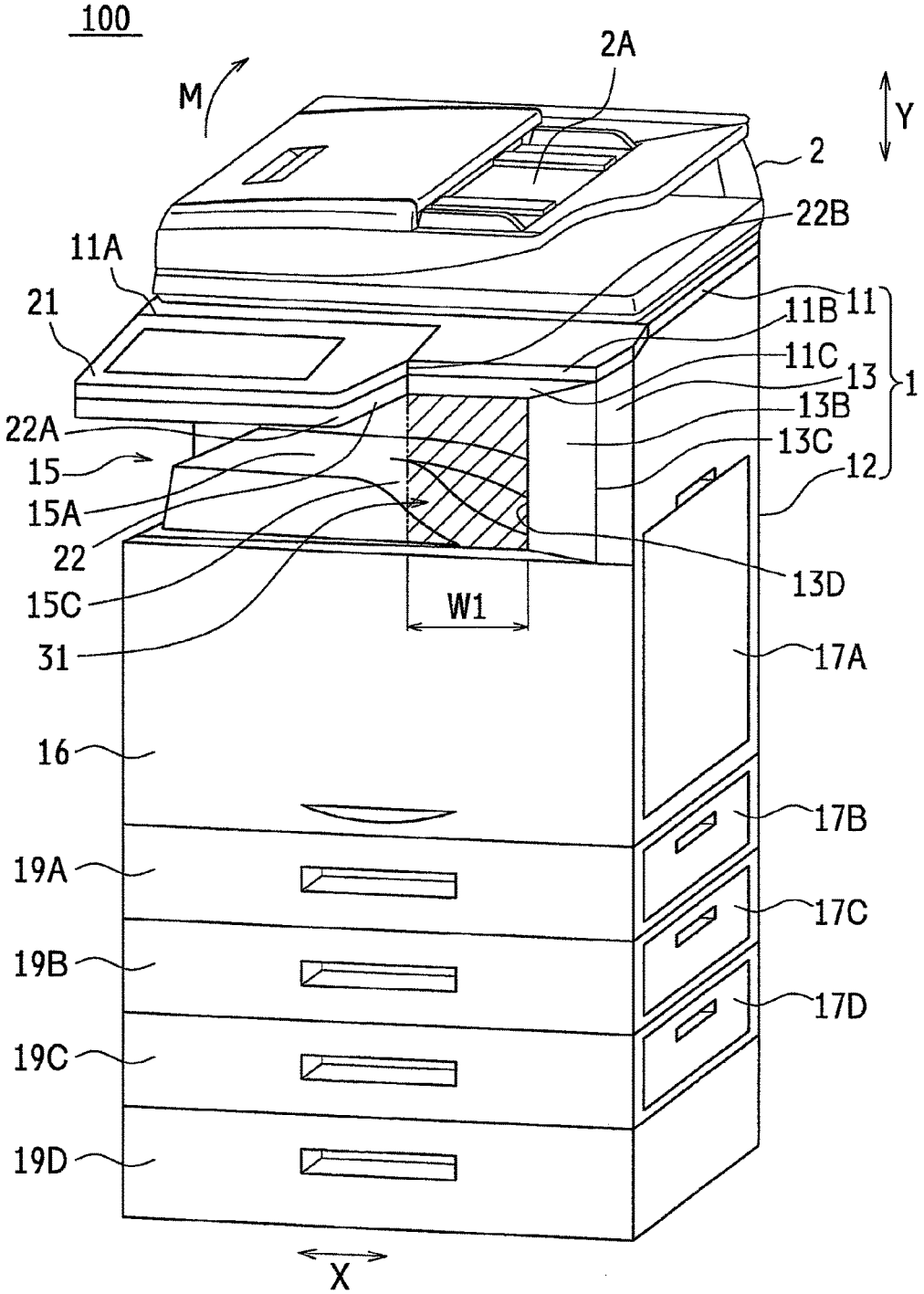
FIG. 1 is an overall perspective view of an image processing apparatus according to an embodiment of the present invention.
Figure 2:
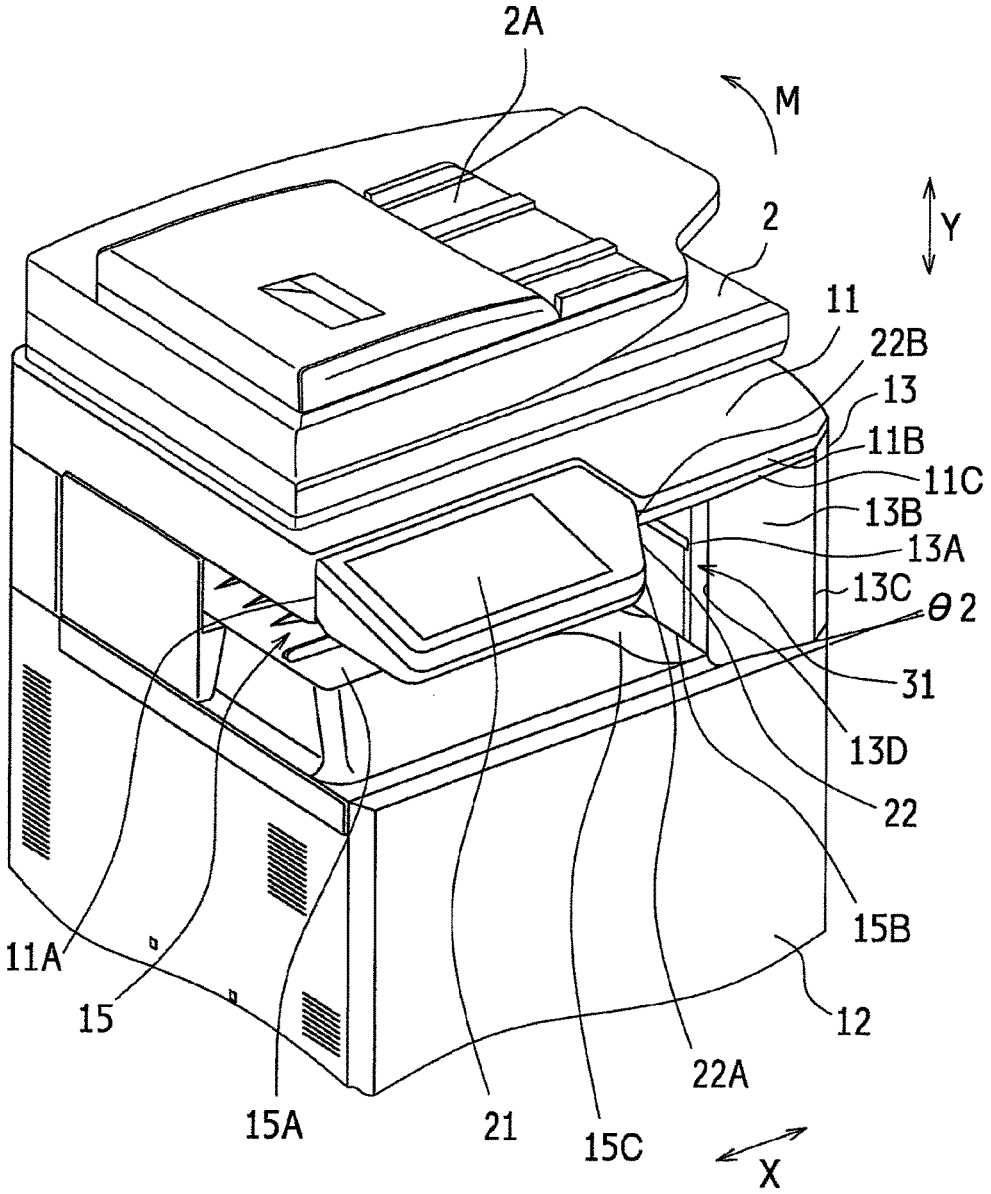
FIG. 2 is an enlarged perspective view showing an upper portion of the image processing apparatus according to the embodiment of the present invention.
Figure 3A:
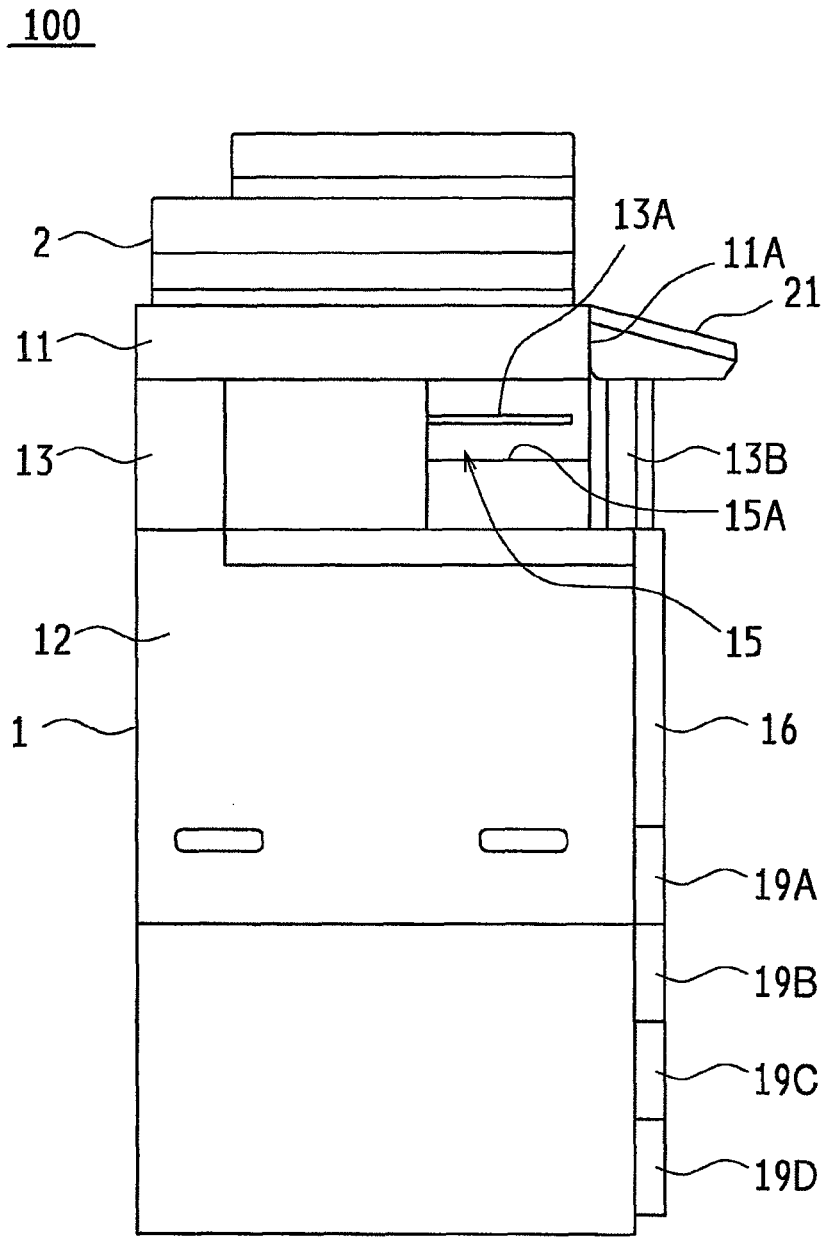
FIG. 3A is a side view of the image processing apparatus according to the embodiment of the present invention when the operation panel portion is horizontally arranged.
Figure 3B:
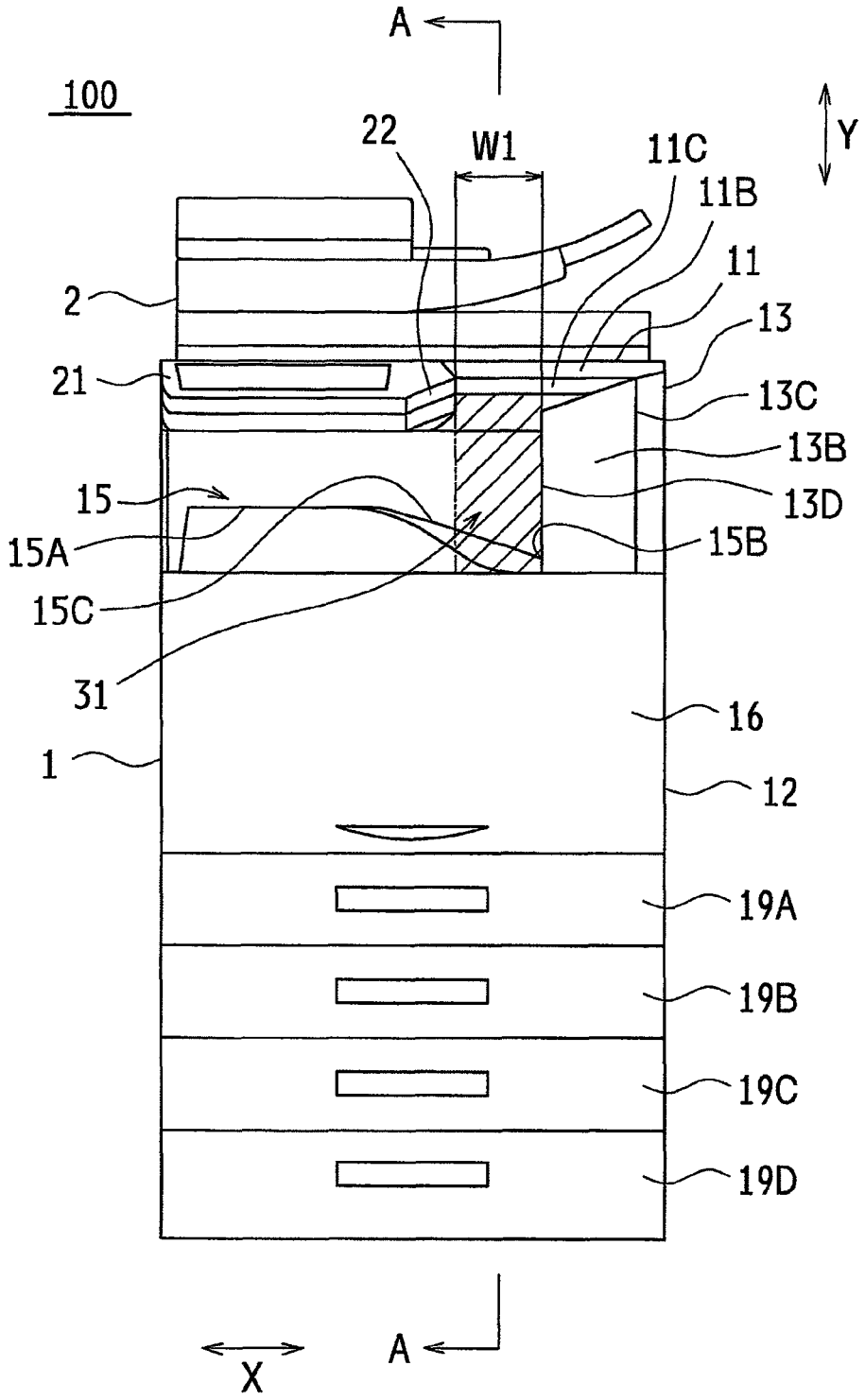
FIG. 3B is a front view of the image processing apparatus according to the embodiment of the present invention when the operation panel portion is horizontally arranged.
Figure 4A:
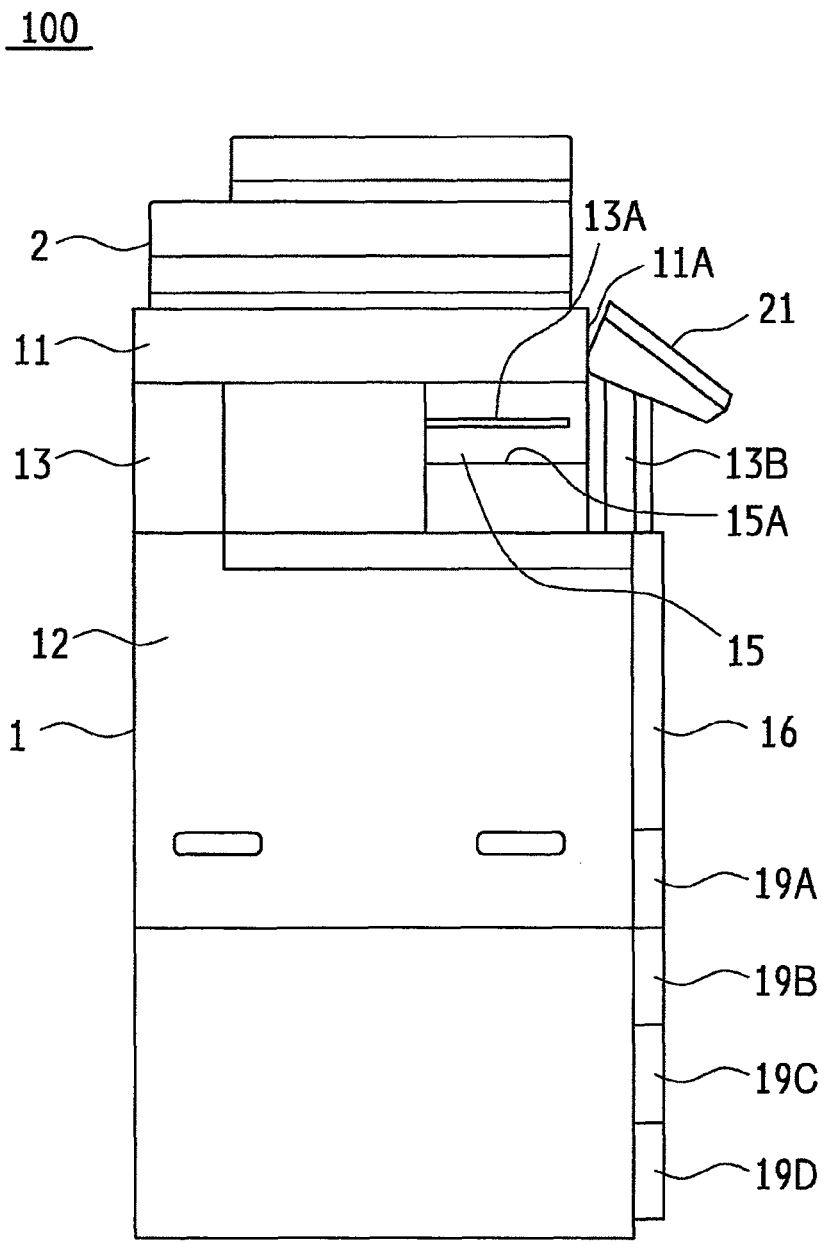
FIG. 4A is a side view of the image processing apparatus according to the embodiment of the present invention when the operation panel portion is arranged so as to be inclined frontward.
Figure 4B:
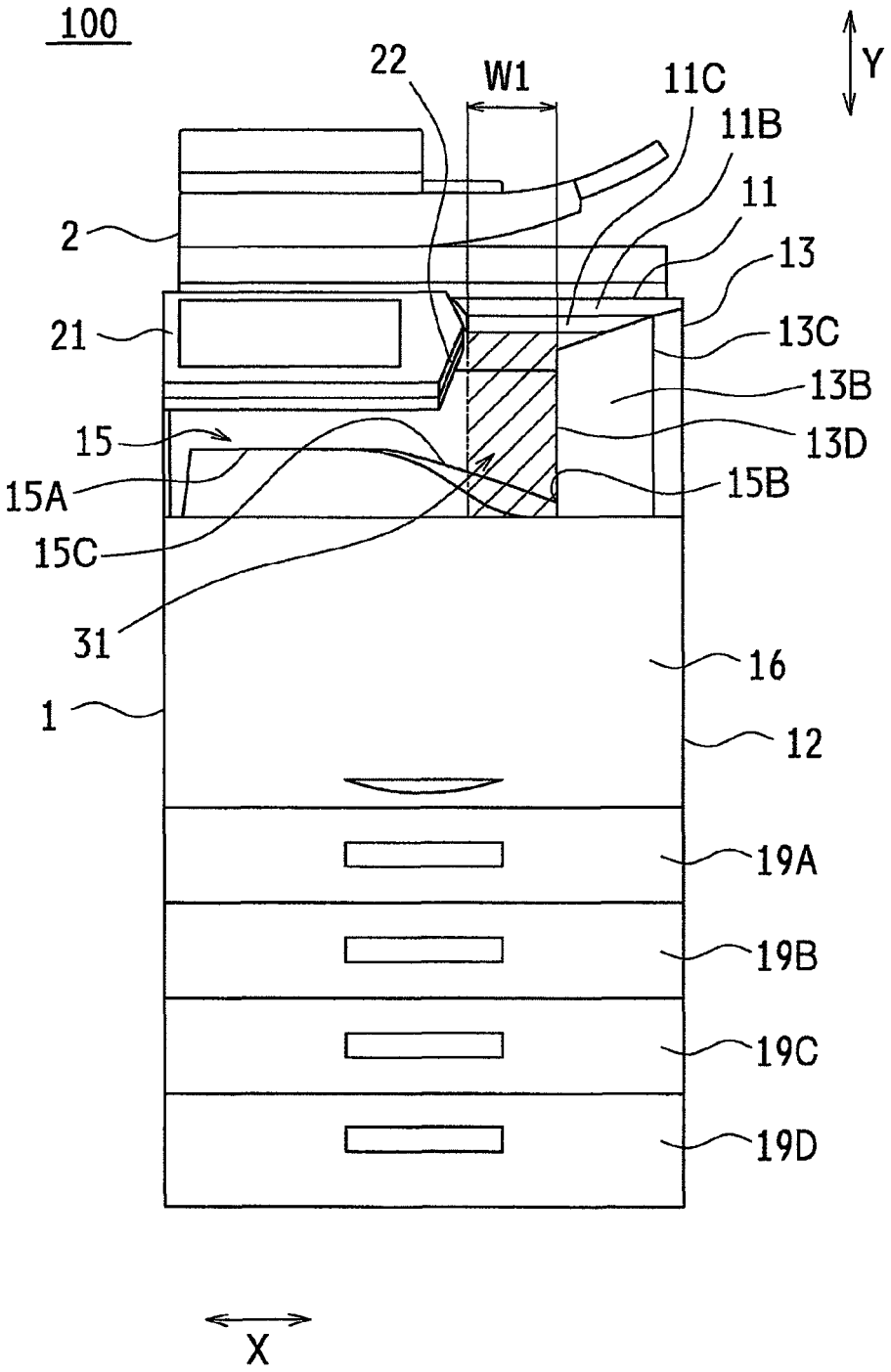
FIG. 4B is a front view of the image processing apparatus according to the embodiment of the present invention when the operation panel portion is arranged so as to be inclined frontward.
Figure 5:
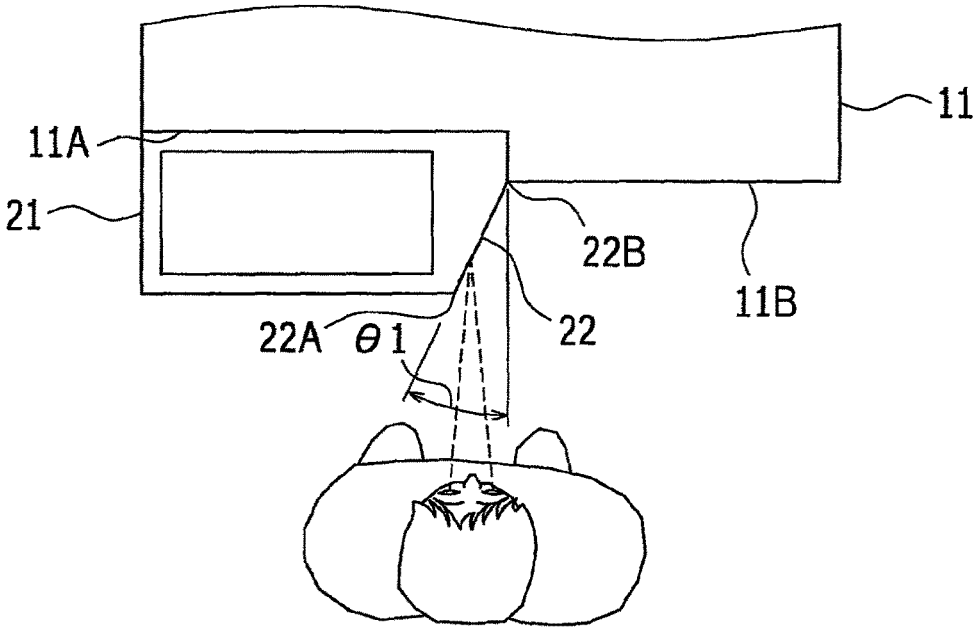
FIG. 5 is an enlarged plan view showing the vicinity of the operation panel portion of the image processing apparatus according to the embodiment of the present invention.
Figure 6:
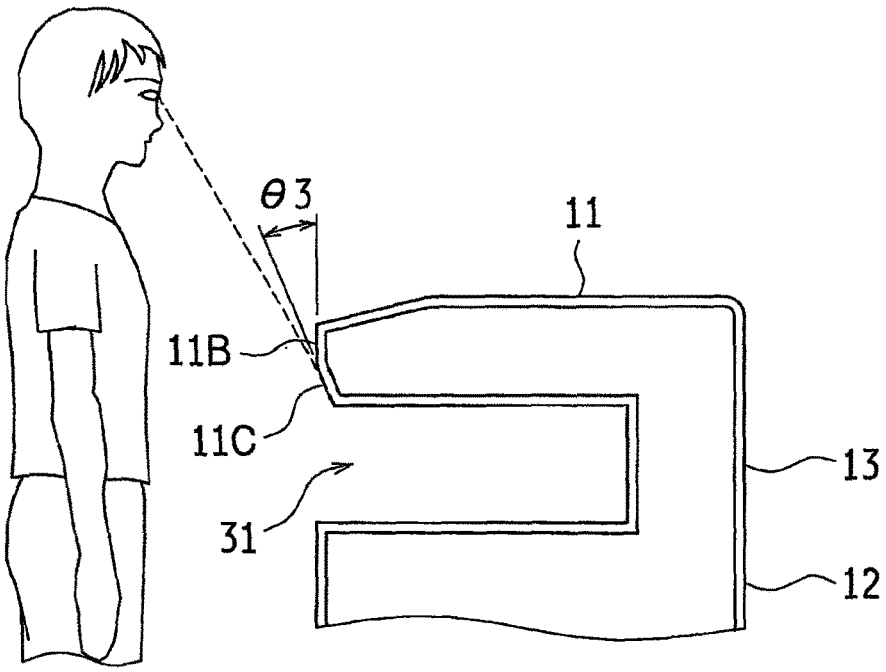
FIG. 6 is a schematic cross-sectional view of a casing portion along line A-A in FIG. 3B.

FIG. 1 is an overall perspective view of an image processing apparatus according to an embodiment of the present invention, FIG. 2 is an enlarged perspective view showing an upper portion of the image processing apparatus according to the embodiment of the present invention, FIG. 3A is a side view of the image processing apparatus in a state where the operation panel portion is horizontally arranged, FIG. 3B is a front view of the image processing apparatus in a state where the operation panel portion is horizontally arranged, FIG. 4A is a side view of the image processing apparatus in a state where the operation panel portion is arranged so as to be inclined frontward, FIG. 4B is a front view of the image processing apparatus in a state where the operation panel portion is arranged so as to be inclined frontward, FIG. 5 is an enlarged plan view showing the vicinity of the operation panel portion, and FIG. 6 is a schematic cross-sectional view of a casing portion along line A-A in FIG. 3B.

An image processing apparatus 100 of this embodiment is configured from an apparatus main body 1 and an automatic document processing device 2. The apparatus main body 1 has an in-body paper discharge structure in which, when viewing the apparatus main body 1 from the front face on the front side, the apparatus main body 1 is substantially in the shape of a U oriented in the width direction of the front face of the apparatus main body 1.

Although not shown, the apparatus main body 1 internally includes, for example, a scanner portion configured from an exposure unit, an image forming portion configured from a developing unit, a photosensitive drum, a cleaner unit, a charger unit, an intermediate transfer belt unit, a fixing unit, and the like, and a paper feed portion configured from a paper feed cassette and a paper transport path.

The external appearance of the apparatus main body 1 is configured from an upper casing 11 that contains the scanner portion (image capture portion) disposed in the main body upper portion, a lower casing 12 that contains the image forming portion and the paper feed portion arranged below the scanner portion, and a link casing 13 that vertically links the upper casing 11 and the lower casing 12 on one side (the right side when viewed from the front in this embodiment) and that has an in-body paper discharge opening 13A (see FIG. 2 etc.) for discharging paper on one side face (on the inner side face positioned inside the apparatus main body 1). Furthermore, a space that is open on the front side of the apparatus main body 1 is positioned between the upper casing 11 and the lower casing 12, and this space is used as an in-body paper discharge portion 15 (paper discharge portion) that stores paper discharged from the in-body paper discharge opening 13A. The front side of the in-body paper discharge portion 15 is open as described above so that paper discharged from the in-body paper discharge opening 13A can be picked up. Furthermore, the link casing 13 contains not only a fixing unit that constitutes part of the image forming portion but also an inner finisher in the case where the inner finisher is provided.

Furthermore, a front face 11A of the upper casing 11 recessed by one step is provided with an operation panel portion 21 substantially in the shape of a rectangle when viewed from above in a vertically tiltable manner. Here, as a tilting structure (a tilting mechanism and a posture adjusting mechanism) for vertically tilting the operation panel portion 21, various mechanism structures have been already proposed, and these well known structures can be applied also to the present invention, and, thus, a description thereof has been omitted. Note that the present applicant filed a patent application in Japan regarding a tilting mechanism and a posture adjusting mechanism for vertically tilting the operation panel portion (see Japanese Patent Application No. 2010-100462).

Furthermore, the upper portion of the upper casing 11 is provided with a document placement stage (not shown) made of transparent glass on which a document is to be placed, and the automatic document processing device 2 is attached onto this document placement stage. The automatic document processing device 2 is a device that automatically transports a document placed on a document placement tray 2A to a document reading position on the document placement stage. Furthermore, the automatic document processing device 2 is configured so as to be freely tiltable in the arrow M direction, and, when the portion above the document placement stage is open, a document can be manually placed.

The image processing apparatus 100 is of a front-access type in which an operation that places a document on the document placement stage, an operation that picks up paper from a discharge tray 15A of the in-body paper discharge portion 15, and an operation that replenishes paper to the paper feed portion can be performed from the front face side (front side) of the apparatus main body 1. Furthermore, the front face of the upper portion of the lower casing 12 is provided with a front door 16, and the right side face to which the link casing 13 is attached is provided with side doors 17A to 17D at four positions arranged in the vertical direction. Furthermore, paper feed cassettes 19A to 19D of the paper feed portion are arranged below the front door 16 such that they can be pulled frontward. It is possible to perform maintenance such as replenishment of toner, replacement of photosensitive bodies, or repair or replacement of fixing units or charger units after opening the front door 16. Furthermore, when removing jammed paper from a paper transport path, the side doors 17A to 17D are opened as necessary. Note that the constituent members arranged in the upper casing 11, the lower casing 12, and the link casing 13 are merely an example except that the discharge tray 15A is disposed in the in-body paper discharge portion 15, and the arrangement and the configuration are not limited to those described above.

In such a configuration, the operation panel portion 21 is disposed close to the other side (the left side when viewed from the front in this embodiment) on the upper casing 11 opposite the side to which the link casing 13 is attached, and an open space (hatched portion in FIGS. 1, 3B and 4B) 31 that allows paper discharged to the in-body paper discharge portion 15 to be viewed is provided between the operation panel portion 21 and the link casing 13. That is to say, when viewing the apparatus main body 1 from the front (front face side), a front face 13B on the front side of the link casing 13 is positioned on one side (the right side in this embodiment) in an intersecting direction (the direction indicated by arrow X in FIGS. 1, 2, 3B, and 4B) that intersects the linkage direction of the upper casing 11 and the lower casing 12 (the direction indicated by arrow Y in FIGS. 1, 2, 3B, and 4B), the operation panel portion 21 is positioned on the other side (the left side in this embodiment) in the intersecting direction, and the open space (hatched portion in FIGS. 1, 3B and 4B) 31 that allows paper discharged to the in-body paper discharge portion 15 to be viewed is positioned between the operation panel portion 21 and the link casing 13.

Here, in this embodiment, the operation panel portion 21 is a keyless panel, which is not provided with conventional analog keys such as a numeric keypad or an on/off key. That is to say, the operation panel portion 21 is configured from a touch panel (keypad)-type liquid crystal display portion. With this configuration, the size of the operation panel portion 21 can be reduced (in particular, the width can be reduced) by the size of analog keys that are not provided, and, as a result, an open space 31 having a sufficient width can be secured between the operation panel portion 21 and the link casing 13.

If the open space 31 that allows paper discharged to the in-body paper discharge portion 15 to be viewed is secured between the operation panel portion 21 and the link casing 13 in this manner, even in a state where the tilt-type operation panel portion 21 has been tilted downward (the state shown in FIGS. 4A and 4B), the operator facing the front face of the apparatus main body 1 can view the in-body paper discharge portion 15 through the open space 31, and can easily check the status of paper being discharged to the in-body paper discharge portion 15. That is to say, unlike conventional examples where the operator checks the paper discharge status by viewing the inside of the in-body paper discharge portion 15 at a slightly low posture or the like, the image processing apparatus 100 of this embodiment is provided with the open space 31, and, thus, the operator does not have to adopt such a low posture, and can sufficiently check paper discharged to the in-body paper discharge portion 15 while standing up.

Furthermore, the discharge tray 15A that is a paper placement face of the in-body paper discharge portion 15 is formed as an inclined face that is lowered toward the in-body paper discharge opening 13A of the link casing 13 (i.e., has an inclined portion 15C that is lowered toward the in-body paper discharge opening 13A of the link casing 13), and the open space 31 is disposed such that a paper alignment reference position (corresponding to a side face having the in-body paper discharge opening 13A of the link casing 13) 15B (see FIGS. 2, 3B and 4B) at the lower edge portion of the inclination of the discharge tray 15A can be viewed.

With this configuration, the operator facing the front face of the apparatus main body 1 can view the paper alignment reference position 15B through the open space 31, and, thus, can check paper discharged to the discharge tray 15A without peering at the inside of the in-body paper discharge portion 15. In this case, the edges of sheets of discharged paper are aligned at the paper alignment reference position 15B, and, thus, discharged paper can be reliably viewed regardless of the paper size. That is to say, even in the case of paper of a small size such as a postcard size or an A5 size, whether or not paper is present can be reliably checked if the paper alignment reference position 15B can be viewed.

Furthermore, a width W1 of the open space 31 is set to a width that allows the operator facing the front face on the front side of the apparatus main body 1 to insert his or her hand into the in-body paper discharge portion 15 and pick up paper from the discharge tray 15A. The width W1 is preferably as large as possible, but, in consideration of the width of the operation panel portion 21, the width of the apparatus main body 1, and the like, it is preferably set to, for example, approximately 10 to 15 cm.

With this configuration, paper discharged to the discharge tray 15A of the in-body paper discharge portion 15 can be viewed, and, moreover, the paper can be easily picked up through the open space 31. Thus, for example, even in a state where the operation panel portion 21 has been tilted downward and partially blocks the in-body paper discharge portion 15 (the state shown in FIGS. 4A and 4B), at least the open space 31 is always open, and, thus, the operator can easily pick up paper placed on the discharge tray 15A of the in-body paper discharge portion 15 by inserting his or her hand into the open space 31.

Furthermore, in this embodiment, a side face 22 on one side (the right side in FIGS. 1, 2, 3B, and 4B) in the intersecting direction (the direction indicated by arrow X in FIGS. 1, 2, 3B, and 4B) of the operation panel portion 21 is inclined from a front edge portion 22A to a rear edge portion 22B that is on a front face 11B side projected by one step in the upper casing 11, thereby forming a first inclined face toward the open space 31. More specifically, an angle θ1 of this inclination (see FIG. 5) is set such that the operator facing the front face on the front side of the apparatus main body 1 can view the open space 31 (i.e., the in-body paper discharge portion 15) along the first inclined face (side face) 22 of the operation panel portion 21. That is to say, the inclination angle is set such that the operator facing the front face of the apparatus main body 1 can slightly see the first inclined face 22 when viewing the open space 31 with the posture at that standing position.

With this configuration, the first inclined face 22 functions as a guide plate that guides the line of sight, and, thus, the line of sight of the operator facing the front face of the apparatus main body 1 (indicated by broken lines in FIG. 5) can be naturally directed toward the open space 31. Accordingly, the operator naturally views the status of paper being discharged to the discharge tray 15A of the in-body paper discharge portion 15, and, thus, a failure to pick up paper and the like can be prevented from occurring. Furthermore, the first inclined face 22 functions as a guide plate also when the operator inserts his or her hand for picking up paper, and, thus, the operation panel portion 21 does not interfere with the hand being inserted into the in-body paper discharge portion 15. That is to say, the operator only has to insert his or her hand along the first inclined face 22.

Furthermore, in this embodiment, the front face 13B of the link casing 13 is also inclined from an edge portion 13C on the outer side to an edge portion 13D on the open space 31 side, thereby forming a second inclined face (inclination angle θ2) toward the inside of the in-body paper discharge portion 15.

With this configuration, the second inclined face 13B functions as a guide plate that guides the line of sight, and, thus, the line of sight of the operator facing the front face of the apparatus main body 1 can be naturally directed toward the open space 31. Accordingly, the operator naturally views the status of paper being discharged to the discharge tray 15A of the in-body paper discharge portion 15, and, thus, a failure to pick up paper and the like can be prevented from occurring.

Furthermore, in this embodiment, a third inclined face 11C inclined toward the in-body paper discharge portion 15 is formed also below the front face 11B projected by one step in the upper casing 11 defining the open space 31. More specifically, an angle θ3 of this inclination (see FIG. 6) is set such that the operator facing the front face of the apparatus main body 1 can view the open space 31 (i.e., the in-body paper discharge portion 15) along the third inclined face 11C of the operation panel portion 21. That is to say, the inclination angle is set such that the operator facing the front face of the apparatus main body 1 can slightly see the third inclined face 11C when viewing the open space 31 with the posture at that standing position.

With this configuration, the third inclined face 11C functions as a guide plate that guides the line of sight, and, thus, the line of sight of the operator facing the front face of the apparatus main body 1 can be naturally directed toward the open space 31. Accordingly, the operator naturally views the status of paper being discharged to the discharge tray 15A of the in-body paper discharge portion 15, and, thus, a failure to pick up paper and the like can be prevented from occurring.

That is to say, according to this embodiment, three sides defining the open space 31 are configured from the first inclined face 22, the second inclined face 13B, and the third inclined face 11C, and, from the view point of the operator facing the front face of the apparatus main body 1, all the faces 22, 13B, and 11C appear to be inclined toward the open space 31. Thus, the line of sight of the operator is naturally guided to the open space 31. Accordingly, the visibility of paper discharged to the discharge tray 15A of the in-body paper discharge portion 15 and the operability in subsequent processes (easiness in picking up paper) can be improved.

Note that, also in this embodiment, the inner wall of the in-body paper discharge portion 15 and the discharge tray 15A are made of materials having a dark color, thereby making it easier to recognize white paper.

The present invention can be embodied and practiced in other different forms without departing from the spirit and essential characteristics thereof. Therefore, the above-described working example is considered in all respects as illustrative and not restrictive. The scope of the invention is indicated by the appended claims rather than by the foregoing description. All variations and modifications falling within the equivalency range of the appended claims are intended to be embraced therein.

DESCRIPTION OF REFERENCE NUMERALS

1 Apparatus main body
2 Automatic document processing device
11 Upper casing
11A Front face recessed by one step
11B Front face projected by one step
11C Third inclined face
12 Lower casing
13 Link casing
13A In-body paper discharge opening (paper discharge opening)
13B Front face (second inclined face)
13C Edge portion on outer side
13D Edge portion open space side
15 In-body paper discharge portion (paper discharge portion)
15A Discharge tray (paper placement face)
15B Paper alignment reference position
15C Inclined portion
16 Front door
17A to 17D Side door
19A to 19D Paper feed cassette
21 Operation panel portion
22 Side face (first inclined face) on one side
31 Open space
100 Image processing apparatus

What is claimed is:

1. An image processing apparatus, comprising:

an apparatus main body whose external appearance is configured from an upper casing that contains an image capture portion, a lower casing that contains an image forming portion, and a link casing that vertically links the upper casing and the lower casing on at least one side of the image processing apparatus in a lateral direction thereof;

a paper discharge portion provided between the upper casing and the lower casing, the paper discharge portion that is to store paper discharged from a paper discharge opening provided on the link casing, and that has a space open on a front side to pick up the stored paper; and an operation panel portion that is disposed in a vertically tiltable manner on a front face of the apparatus main body, wherein an open space is provided between the operation panel portion and the link casing, and wherein an inclined face that is inclined toward the paper discharge portion is formed in a lower portion of the front face of the upper casing defining the open space.

2. The image processing apparatus according to claim 1, wherein a paper placement face of the paper discharge portion has an inclined portion that is lowered toward the paper discharge opening, and the open space is provided such that a paper alignment reference position at a lower edge portion of the inclined paper placement face can be viewed.

3. The image processing apparatus according to claim 1, which is configured such that an operator facing a front face on the front side of the apparatus main body can view the paper discharge portion along a first inclined face that is a side face on the one side of the operation panel portion in the lateral direction thereof.

4. The image processing apparatus according to claim 1, wherein a front face of the link casing is formed as a second inclined face that is inclined from an edge portion on an outer side to an edge portion on an open space side.

5. An image processing apparatus, comprising:

an apparatus main body whose external appearance is configured from an upper casing that contains an image capture portion, a lower casing that contains an image forming portion, and a link casing that vertically links the upper casing and the lower casing on at least one side of the image processing apparatus in a lateral direction thereof;

a paper discharge portion provided between the upper casing and the lower casing, the paper discharge portion that is to store paper discharged from a paper discharge opening provided on the link casing, and that has a space open on a front side to pick up the stored paper; and an operation panel portion that is disposed in a vertically tiltable manner on a front face of the apparatus main body, wherein an open space toward outside is provided beside the operation panel portion, and wherein an inclined face that is inclined toward the paper discharge portion is formed in a lower portion of the front face of the upper casing defining the open space.

6. The image processing apparatus according to claim 5, wherein even in a state where the operation panel portion has been tilted downward, the open space to pick up the paper discharged to the paper discharged portion is provided on a front face side.

7. The image processing apparatus according to claim 5, wherein a paper placement face of the paper discharge portion has an inclined portion that is lowered toward the paper discharge opening, and wherein the open space is provided such that a paper alignment reference position at a lower edge portion of the inclined paper placement face can be viewed.

8. The image processing apparatus according to claim 5, wherein a side face on one side in an intersecting direction of the operation panel portion is formed as a first inclined face that is inclined from a front edge portion to a rear edge portion that is on the front face side of the upper casing, and wherein the image processing apparatus is configured such that an operator facing a front face on a front side of the apparatus main body can view the paper discharge portion along the first inclined face of the operation panel portion.

9. The image processing apparatus according to claim 5, wherein a front face of the link casing is formed as a second inclined face that is inclined from an edge portion on an outer side to an edge portion on the open space side.

10. An image processing apparatus, comprising:

an apparatus main body whose external appearance is configured from an upper casing that contains an image capture portion, a lower casing that contains an image forming portion, and a link casing that vertically links the upper casing and the lower casing on at least one side of the image processing apparatus in a lateral direction thereof;

a paper discharge portion provided between the upper casing and the lower casing, the paper discharge portion that is to store paper discharged from a paper discharge opening provided on the link casing, and that has a space open on a front side to pick up the stored paper, and an operation panel portion that is disposed in a tiltable manner on a front face of the apparatus main body, wherein an open space toward outside on the paper discharge portion is provided in a position different from a position in which the operation panel portion is located, and wherein an inclined face that is inclined toward the paper discharge portion is formed in a lower portion of the front face of the upper casing defining the open space.

11. The image processing apparatus according to claim 10, wherein a paper placement face of the paper discharge portion has an inclined portion that is lowered toward the paper discharge opening, and wherein the open space is provided such that a paper alignment reference position at a lower edge portion of the inclined paper placement face can be viewed.

12. The image processing apparatus according to claim 10, wherein a side face on one side in an intersecting direction of the operation panel portion is formed as a first inclined face that is inclined from a front edge portion to a rear edge portion that is on the front face side of the upper casing, and wherein the image processing apparatus is configured such that an operator facing a front face on a front side of the apparatus main body can view the paper discharge portion along the first inclined face of the operation panel portion.

13. The image processing apparatus according to claim 10, wherein a front face of the link casing is formed as a second inclined face that is inclined from an edge portion on an outer side to an edge portion on the open space side.

* * * * *